US012187974B2

(12) United States Patent
Weber et al.

(10) Patent No.: US 12,187,974 B2
(45) Date of Patent: Jan. 7, 2025

(54) OIL-BASED CORROSION INHIBITORS

(71) Applicant: The Lubrizol Corporation, Wickliffe, OH (US)

(72) Inventors: Ryan Weber, Solon, OH (US); Samantha Lauro, Austin, TX (US); Christina Brancel, Painesville, OH (US); Britt Minch, Painesville, OH (US); Eric Rodeheaver, Montville Township, OH (US); Nicholas S. Pottschmidt, Medina, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 17/910,576

(22) PCT Filed: Feb. 2, 2021

(86) PCT No.: PCT/US2021/016169

§ 371 (c)(1),
(2) Date: Sep. 9, 2022

(87) PCT Pub. No.: WO2021/183230

PCT Pub. Date: Sep. 16, 2021

(65) Prior Publication Data

US 2023/0151294 A1 May 18, 2023

Related U.S. Application Data

(60) Provisional application No. 62/988,460, filed on Mar. 12, 2020.

(51) Int. Cl.

| | |
|---|---|
| ***C10M 163/00*** | (2006.01) |
| ***C10M 129/56*** | (2006.01) |
| *C10N 10/02* | (2006.01) |
| *C10N 10/04* | (2006.01) |
| *C10N 30/12* | (2006.01) |

(52) U.S. Cl.
CPC ..... *C10M 163/00* (2013.01); *C10M 129/56* (2013.01); *C10M 2207/126* (2013.01); *C10M 2207/127* (2013.01); *C10M 2207/129* (2013.01); *C10M 2219/044* (2013.01); *C10N 2010/02* (2013.01); *C10N 2010/04* (2013.01); *C10N 2030/12* (2013.01)

(58) Field of Classification Search
None
See application file for complete search history.

(56) References Cited

U.S. PATENT DOCUMENTS

| | | | | |
|---|---|---|---|---|
| 3,965,017 | A | 6/1976 | Burnop et al. | |
| 4,253,977 | A | 3/1981 | O'Halloran | |
| 4,396,515 | A | 8/1983 | Sturwold | |
| 10,196,581 | B2 | 2/2019 | Walker et al. | |
| 10,640,723 | B2 | 5/2020 | Fang | |
| 2004/0058840 | A1 | 3/2004 | Hsu et al. | |
| 2009/0062165 | A1* | 3/2009 | Denis | C10M 121/04 508/172 |
| 2011/0160110 | A1* | 6/2011 | Daegling | C10M 169/00 508/532 |
| 2018/0201860 | A1* | 7/2018 | Ransom | F02P 5/02 |
| 2019/0241824 | A1 | 8/2019 | Barton et al. | |

FOREIGN PATENT DOCUMENTS

| | | |
|---|---|---|
| WO | 2012/024680 | 2/2012 |

* cited by examiner

*Primary Examiner* — Vishal V Vasisth
(74) *Attorney, Agent, or Firm* — Iken S. Sans; Michael A. Miller

(57) ABSTRACT

Compositions comprising a) a metal detergent and b) an acid comprising at least one hydrocarbyl-substituted carboxylic acid. The metal detergent comprises at least one alkali metal, alkaline earth metal, or combinations thereof. The weight ratio of the metal detergent a) to the acid b) ranges from 50:1 to 1:10, or 25:1 to 1:10, or 10:1 to 1:10, or 5:1 to 1:7, or 2:1 to 1:3. The compositions may be added to industrial coating or lubricant compositions to reduce corrosion of metal components.

11 Claims, No Drawings

OIL-BASED CORROSION INHIBITORS

CROSS REFERENCE TO RELATED APPLICATION

This application claims priority from PCT Application Serial No. PCT/US2021/016169 filed on Feb. 2, 2021, which claims the benefit of U.S. Provisional Application No. 62/988,460 filed on Mar. 12, 2020, both of which are incorporated in their entirety by reference herein.

FIELD OF THE INVENTION

The field of the disclosed technology is generally related to oil-based corrosion inhibitors for use in lubricating compositions.

BACKGROUND OF THE INVENTION

Oil-based corrosion inhibitors are an essential component to myriad industrial, automotive, and manufacturing fluids ranging from engine oils to hydraulic fluids to metal forming fluids. While these materials must obviously display excellent corrosion protection, they should also be low cost and sustainable to manufacture. Commonly used corrosion inhibitor used in used in metalworking lubricants rely on petroleum wax as a key component (e.g. Lubrizol's ALOX 2100). Petroleum wax is becoming scarce and therefore more expensive for use as a raw material because of a decline of group I oil refineries. Thus, there is a need for corrosion inhibitors that do not rely on petroleum wax.

Over-based metal sulfonates having of a high Total Base Number ("TBN") of about 200 to 500 mg/KOH/g are known to be effective corrosion inhibitors because their basicity can neutralize corrosive acids that may be present in the lubricant. Prior to the present invention, mildly over-based metal sulfonates (TBN-40-50 mgKOH/g) tended to be poor corrosion inhibitors because they contain less base.

SUMMARY OF THE INVENTION

The inventors of the present technology, however, found that products of over-based metal sulfonates reacted with an acid mixture of organic sulfonic acid and at least one carboxylic acid resulted in low TBN detergents that are surprisingly effective corrosion inhibitors. These products are petroleum-wax free, making them a more sustainably-sourced material. Furthermore, these new materials are less expensive and easier to manufacture than many corrosion inhibitors currently available. Moreover, the disclosed corrosion inhibitors are versatile enough to be used in multiple technical applications as they perform well as either oil-based corrosion inhibitors or as thin-film rust preventives. This versatility can be attractive to lubricant formulators that desire to source a single material to serve multiple purposes.

Accordingly, compositions comprising: metal detergent; and an acid comprising at least one hydrocarbyl-substituted carboxylic acid are disclosed. The metal detergent may comprise at least one alkali metal, alkaline earth metal, or combinations thereof. The weight ratio of the metal detergent a) to the acid b) may range from 50:1 to 1:10, or 25:1 to 1:10, or 10:1 to 1:10, or 5:1 to 1:7, or 2:1 to 1:3.

In some embodiments, the metal detergent comprises at least one phenate, salicylate, salixarate, sulfonate, or combinations thereof. The metal detergent may be a metal overbased detergent. Suitable metals include, but are not limited to, calcium, sodium, barium, magnesium, or combinations thereof.

In some embodiments the acid further comprises at least one hydrocarbyl-substituted organic sulfonic acid. The weight ratio of the at least one organic sulfonic acid to the at least one carboxylic acid may range from 15:1 to 3:1. In other embodiments, the hydrocarbyl-substituted organic sulfonic acid may be mono or di substituted alkylsulfonic acid, for example, naphthalene sulfonic acid, alkylbenzene-sulfonic acid, or combinations thereof.

In some embodiments, the at least one carboxylic acid may comprise at least one $C_8$ to $C_{36}$ hydrocarbyl-substituted polycarboxylic acid. In other embodiments, the acid may comprise at least two carboxylic acids and wherein at least one of the carboxylic acids is a $C_8$ to $C_{36}$ hydrocarbyl-substituted polycarboxylic acid. It yet other embodiments, at least one of the carboxylic acids is a monocarboxylic acid and wherein the weight ratio of the polycarboxylic acid to the monocarboxylic acid ranges from 10:1 to 1:1, or 3:1.

The monocarboxylic acid may be a linear or branched $C_8$ to $C_{36}$ hydrocarbyl-substituted monocarboxylic acid. In some embodiments, the monocarboxylic acid may be a saturated or unsaturated $C_8$ to $C_{36}$ hydrocarbyl-substituted monocarboxylic acid. Accordingly, in some embodiments, the monocarboxylic acid may be a linear unsaturated $C_8$, $C_{10}$, $C_{12}$, or $C_{14}$ to $C_{36}$, or $C_{10}$ to $C_{18}$ hydrocarbyl-substituted monocarboxylic acid.

In some embodiments, the polycarboxylic acid may have at least 4 carbon atoms separating the acid functional groups. In yet other embodiments, the polycarboxylic acid may have 4 to 18 carbon atoms separating the acid functional groups In some embodiments, the at least one carboxylic acid may comprise a hydroxyalkyl carboxylic acid-ester. In some embodiments, the at least one polycarboxylic acid is a dicarboxylic acid, a tricarboxylic acid, or mixtures thereof. Suitable dicarboxylic acids include a $C_{36}$ dicarboxylic acids, $C_{21}$ tricarboxylic acids, and combinations thereof. Accordingly, in some embodiments the dicarboxylic acid may be a $C_{36}$ dicarboxylic acid and the monocarboxylic acid may be a linear unsaturated $C_{14}$ to $C_{18}$ hydrocarbyl-substituted monocarboxylic acid.

DETAILED DESCRIPTION OF THE INVENTION

Various preferred features and embodiments will be described below by way of non-limiting illustration. The disclosed technology pertains to compositions that perform surprisingly better as corrosion inhibitors than mildly over-based metal sulfonates. The novel compositions comprise a) a metal detergent and b) an acid comprising at least one hydrocarbyl-substituted carboxylic acid. The metal detergent may comprise at least one alkali metal, alkaline earth metal, or combinations thereof. The weight ratio of the metal detergent a) to the acid b) may range from 50:1 to 1:10, or 25:1 to 1:10, or 10:1 to 1:10, or 5:1 to 1:7, or 2:1 to 1:3.

In some embodiments, the metal detergent comprises at least one phenate, salicylate, salixarate, sulfonate, or combinations thereof. In some embodiments, the metal detergent is a metal sulfonate detergent. The metal sulfonate may typically be a salt of an alkylarylsulfonate having one or more hydrocarbyl or alkyl groups of sufficient length to provide solubility in a hydrocarbon oil. The "sufficient length" may be at least 12 carbon atoms and up to 200 carbon atoms, such as 18 to 100 or 24 to 48 carbon atoms in the combined alkyl or hydrocarbyl groups or, alternatively, in the longest of such groups if there is more than one. In one embodiment, each hydrocarbyl or alkyl group may individually contain at least 8 or at least 12 carbon atoms, and up to 200 carbon atoms, or 18 to 100 or 24 to 48. Examples of metal sulfonate salts include relatively low molecular weight salts such as calcium mono-, di-, or tri-nonyl naphthalene sulfonate (or mixtures of mono-, di-, and trialkyl species) and relatively higher molecular weight salts such as calcium oligo- or poly-propene benzenesulfonates or -toluenesulfonates.

These may be neutral salts or overbased salts. Neutral salts are those that contain approximately or exactly a stoichiometric amount of metal ion to neutralize the acid functionality of the alkarylsulfonic acid. Overbased salts are prepared by reaction with a stoichiometric excess of metal, such as calcium, barium, magnesium, potassium, zinc, or sodium, in the form of a basic compound such as, in the case of calcium, the oxide, hydroxide or, ultimately, the carbonate as a result of treatment with carbon dioxide. Accordingly, in some embodiments, the metal detergent may be a metal overbased detergent. Overbased materials are well known in the lubricant industry as overbased detergents and may also function as surfactants or wetting agents. In certain embodiments, the salt may be a calcium, barium, or sodium salt. In yet other embodiments the salt may be a calcium or magnesium salt. The TBN of the metal detergent may range from 15 to 500 mg KOH/g, or 25 to 400 mg KOH/g. TBN is an expression frequently used to describe the basicity of lubricant additives and/or lubricants. It is the amount of potassium hydroxide (mg KOH) needed to neutralize one gram of the sample being tested using titration and bromophenol blue as in indicator. Such TBN titration methods are well known in the art and have been standardized in the industry such as in ASTM D2896.

In some embodiments, the metal sulfonate may be a salt of an alkarylsulfonic acid that contains an alkyl group of 9 to 200, or 12 to 200, or 18 to 100, or 25 to 50, or 30 to 40 carbon atoms. Such materials are typically provided in commercial form in the presence of an amount of a diluent oil, typically a mineral oil such as an API Group I oil, in which they are often prepared. The amount of diluent oil that may be associated with and accompany the metal alkylarylsulfonate salt may be in the ratio of 1:5 to 5:1 of the salt to oil. Overbased detergents are described in detail in U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Accordingly, in some embodiments, the metal detergent may be a calcium sulfonate detergent. The calcium sulfonate detergent may be neutral or overbased. In yet other embodiments, the metal detergent is an overbased calcium sulfonate detergent.

The amount of the metal detergent (for example a metal sulfonate) in the disclosed composition may range from 2 to 30 percent by weight, or 3 to 30, or 3 to 25, or 4 to 20, or 5 to 15 percent by weight, on an oil-free basis. The quoted amounts, as above, exclude the amount of any volatile diluent that may be present.

In some embodiments the acid used to make the novel compositions may further comprise at least one hydrocarbyl-substituted organic sulfonic acid. The weight ratio of the at least one organic sulfonic acid to the at least one carboxylic acid may range from 15:1 to 3:1. In other embodiments, the hydrocarbyl-substituted organic sulfonic acid may be mono or di substituted alkylsulfonic acid, for example, naphthalene sulfonic acid, alkylbenzenesulfonic acid, or combinations thereof.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

- hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);
- substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);
- hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

The disclosed technology also includes a hydrocarbyl-substituted carboxylic acid. The acid may be a monoacid or it may be a polyacid. By "polyacid" is meant a material having two or more carboxylic acid groups. In some embodiments, the acid may be a poly carboxylic acid having at least 8 carbon atoms.

Suitable polyacids include diacids. One type of diacid is known as dimer acids or dimerized acids. Dimer acids are products typically prepared by dimerization of long chain, e.g., $C_{18}$, unsaturated fatty acids. They are often prepared by self-condensation of oleic acid or tall oil fatty acids. Dimer acids are mixtures of relatively high molecular weight materials (around 560) yet are liquid at room temperature. They are commercially available materials that may be prepared by either a Diels-Alder reaction or by a free radical route, or by catalysis on a substrate such as clay. Dimer acids and their preparation are extensively discussed in the *Kirk-Othmer Encyclopedia of Chemical Technology*, Third Edition, volume 7, pages 768-782, John Wiley & Sons, New York (1979).

In another embodiment, a diacid may include a hydrocarbyl-substituted succinic acid having at least 14 carbon atoms including the four carbon atoms of the succinic acid moiety, e.g., succinic acid substituted with a 10-carbon alkyl. In other embodiments there will be at least 12, 14, 16, or 18 carbon atoms in such an alkyl substituent (for a total number of 16, 18, 20, or 22 carbon atoms). The number of atoms in the alkyl substituent may be up to 36 or 30 or 24 or 22 carbon atoms.

In another embodiment, the diacid may be an α, ω-alkylene diacid, of at least 10 or 12 carbon atoms, and up to, for instance, 36 or 24 or 18 carbon atoms. Examples include 1,10-decanedioic acid, 1,12-dodecanedioic acid, and 1,18-octadecanedioic acid. In one embodiment, the a hydrocarbyl-substituted carboxylic acid may comprise a $C_{36}$ carboxylic dimer acid.

In some embodiments, the at least one carboxylic acid may comprise at least one $C_8$ to $C_{36}$ hydrocarbyl-substituted polycarboxylic acid. In other embodiments, the acid may comprise at least two carboxylic acids and wherein at least one of the carboxylic acids is a $C_8$ to $C_{36}$ hydrocarbyl-substituted polycarboxylic acid. In some embodiments, the polycarboxylic acid may have at least 4 carbon atoms separating the acid functional groups. In yet other embodiments, the polycarboxylic acid may have 4 to 18 carbon atoms separating the acid functional groups. The separating carbon atoms in such embodiments are typically non-aromatic and, in one embodiment, they comprise a carbon chain, that is, without interruption by inserted oxygen or nitrogen atoms. In certain embodiments the carboxylic groups may be separated by 8 to 24 carbon atoms, or 10 to 20, or 12 to 20, or 14 to 18 carbon atoms.

It some embodiments, at least one of the carboxylic acids is a monocarboxylic acid and wherein the weight ratio of the polycarboxylic acid to the monocarboxylic acid ranges from 10:1 to 1:1, or 3:1. The monocarboxylic acid may have at least 10 carbon atoms. In some embodiments it may have a carbon chain of 8 to 24 carbon atoms. Such acids are often derived by hydrolysis of natural oils or fats. They may be saturated or unsaturated and may contain additional substituents such as a hydroxy group. These acids, sometimes referred to as fatty acids, are well known and may typically include stearic acid, hydroxystearic acid, or oleic acid. Accordingly, in one embodiment, the hydrocarbyl-substituted carboxylic acid may comprise oleic acid.

In some embodiments, the monocarboxylic acid may be a linear or branched $C_8$ to $C_{36}$ hydrocarbyl-substituted monocarboxylic acid. In some embodiments, the monocarboxylic acid may be a saturated or unsaturated $C_8$ to $C_{36}$ hydrocarbyl-substituted monocarboxylic acid. Accordingly, in some embodiments, the monocarboxylic acid may be a linear unsaturated $C_8$, $C_{10}$, $C_{12}$, or $C_{14}$ to $C_{36}$, or $C_{10}$ to $C_{18}$ hydrocarbyl-substituted monocarboxylic acid.

In some embodiments, the at least one carboxylic acid may comprise a hydroxyalkyl carboxylic acid-ester, such as dodecenylsuccinic acid, hydroxypropyl mono-ester. In some embodiments, the at least one polycarboxylic acid is a dicarboxylic acid, a tricarboxylic acid, or mixtures thereof. Suitable dicarboxylic acids include a $C_{36}$ dicarboxylic acids. Suitable $C_{21}$ tricarboxylic acids include triazine-triyltriimino tris-hexanoic acid. Accordingly, in some embodiments the dicarboxylic acid may be a $C_{36}$ dicarboxylic acid and the monocarboxylic acid may be a linear unsaturated $C_{14}$ to $C_{18}$ hydrocarbyl-substituted monocarboxylic acid.

In some embodiments, the at least one carboxylic acid may comprise at least one $C_8$ to $C_{36}$ hydrocarbyl-substituted polycarboxylic acid. In other embodiments, the acid mixture comprises at least two carboxylic acids and at least one of the carboxylic acids is a $C_8$ to $C_{36}$ hydrocarbyl-substituted polycarboxylic acid. In yet another embodiment, the hydrocarbyl-substituted carboxylic acid may comprise a $C_{36}$ carboxylic dimer acid and a $C_{21}$ tricarboxylic acid.

Accordingly, specific carboxylic acids suitable for use in the disclosed technology include, but are not limited to, a $C_{36}$ dimer carboxylic acid, a $C_{21}$ tricarboxylic acid, adipic acid ($C_6$ diacid), oleic acid ($C_{18}$ linear-unsaturated carboxylic acid), neodaconic acid ($C_{10}$ branched-saturated carboxylic acid), cocoa fatty acid (Cu linear-saturated carboxylic acid), hydroxyalkyl carboxylic acid-ester, or combinations thereof. In one embodiment, the composition may comprise a $C_{36}$ dimer carboxylic acid and oleic acid.

The amount of the above-described carboxylic acid, whether monoacid, diacid, or polyacid in the disclosed composition, may be 4 to 25 percent by weight, or 6 to 10 percent by weight, calculated excluding the presence of any volatile diluent or diluent oil.

The compositions will also contain an oil in an amount sufficient to dissolve the metal salt of the alkylarylsulfonic acid. The oil may be a natural or synthetic oil, an oil derived from hydrocracking, hydrogenation, and hydrofinishing, an unrefined, refined, re-refined oil, or mixtures thereof. A more detailed description of unrefined, refined and re-refined oils is provided in International Publication WO2008/147704, paragraphs [0054] to and in the corresponding paragraphs of US-2010-0197536. A more detailed description of natural and synthetic lubricating oils is described in paragraphs [0058] to [0059] respectively of WO2008/147704. Synthetic oils may also be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils. In another embodiment, the oil may be selected from any of the base oils in Groups I-V as specified in the American Petroleum Institute (API) Base Oil Interchangeability Guidelines. The five base oil groups are as follows: Group I: >0.03% sulfur and/or <90% saturates and viscosity index (VI) 80 to 120; Group II: <0.03% sulfur and >90% saturates and VI 80 to 120; Group III: <0.03% sulfur and >90% saturates and VI>120; Group IV: all polyalphaolefins; Group V: all others. Groups I, II and III are mineral oil base stocks. Natural oils also include vegetable oils such as coconut oil, castor oil, olive oil, peanut oil, rapeseed (canola) oil, corn oil, sesame seed oil, cottonseed oil, soybean oil, palm oil, sunflower oil, safflower oil, linseed oil, and tung oil. In one embodiment the oil is a hydrocarbon oil. In other embodiments the oil may be a mineral oil, or it may be other than a mineral oil, e.g., a poly-α-olefin oil, trimethylolpropane trioleate (TMP-TO), polyalkylene glycol, or a vegetable oil, or the like.

The amount of oil, such as hydrocarbon oil, in the disclosed compositions may be 2 to 80 percent by weight, 5 to 70 or 10 to 45 or 15 to 35 percent by weight, or 2 to 30 percent by weight. In another embodiment the oil, such as hydrocarbon oil, may be 70 to 98 percent of the composition. In one embodiment, the amount of the metal detergent is 2 to 30 percent by weight, the amount of the at least one carboxylic acid is 4 to 25 percent by weight, and the amount of the hydrocarbon oil is 45 to 94 percent by weight.

The composition may also optionally contain a volatile diluent. By "volatile diluent" is meant a normally liquid component that has a volatility greater than that of an oil such as mineral oil. The volatile diluent may comprise water or one or more organic solvents. The diluent may thus comprise a volatile organic solvent such as naphtha (also known as petroleum ether), mineral spirits, kerosene, or ethyl lactate. Among these materials may be hydrocarbon solvents. Such materials may have a boiling point of 30 to 60° C. or higher temperatures, up to a range of 175 to 280° C. Some such volatile diluents may have a boiling range of 130-210° C.; others 196-205° C. Overall, a diluent may be considered volatile if its boiling point is less than 280° C.

The volatile diluent may be present in a concentrate of the foregoing components, if desired, although most commonly the diluent, or the majority of the diluent will be added in preparing the fully formulated, diluted composition. The amount of diluent will typically be an amount to provide for appropriate viscosity and rheological performance so that the composition may be applied to a substrate such as a metallic article or surface. Thus, if the concentrate is diluted to 20 percent in the final composition, the total amount of diluent will typically 80 percent additional solvent or diluent to make the dilution (in addition to the oil dissolving the metal salt, which is not counted toward the amount of the volatile diluent). The overall total amount of the diluent (if present) will depend, of course, on the amount of dilution used to prepare the final composition and so may be 40 to 98 percent by weight, or 60 to 98, or 40 to 95, or 60 to 88, or 80 to 86, or 82 to 84 percent by weight. The amount of the other components will typically be 100% by weight less the amount of the optional volatile diluent, such as 2 to 60 weight percent and other amounts that may be readily determined by the skilled person.

The composition comprising a metal detergent and an acid comprising at least one hydrocarbyl-substituted carboxylic acid may have a total base number ("TBN"), ranging from at least 10 to 65 mg KOH/g. In other embodiments, the TBN may range from 20 to 60 mg KOH/g; 40 to 60 mg KOH/g; or 25 to 55 mg KOH/g. If the optional oil or solvent is present the TBN may be inclusive of the oil or solvent. The TBN for solvent and/or oil diluted compositions may range from 0.1 to 50 mg KOH/g, or 0.1 to 40 mg KOH/g.

The compositions disclosed herein may have a composition defined in Table 1 below.

TABLE 1

| Inventive Compositions Embodiments (wt %) | | | |
|---|---|---|---|
| | A | B | C |
| Metal Detergent | 15-40 | 15-35 | 20-35 |
| Carboxylic Acid | 5-15 | 5-15 | 3-6 |
| Organic Sulfonic Acid | 0 | 5-55 | 20-45 |
| Diluent Oil or Solvent | Balance to 100% | Balance to 100% | Balance to 100% |

Methods of reducing the corrosion of a metal component are also disclosed. The methods may comprise coating the metal component with the compositions described above. The disclosed compositions may be used in a fluid, such as a coating, an industrial gear oil, or in a hydraulic oil to reduce the corrosion in metals that such fluids are in contact with. In some embodiments, the composition is a coating composition comprising a metal detergent and an acid as described above along with a solvent (for example mineral spirits or naphtha), an oil (for example a Group I or Group II paraffinic oil), or mixtures thereof. In some embodiments, the composition is an industrial gear oil composition comprising a metal detergent and an acid as described above along with a Group I basestock. In yet other embodiments, the composition is a hydraulic oil composition comprising a metal detergent and an acid as described above along with a Group II basestock.

INDUSTRIAL APPLICATION

The disclosed compositions may be used as corrosion inhibitors. Some of the disclosed compositions may be soluble in an oil, or solvent, and some compositions may even be soluble in both an oil and a solvent. The disclosed compositions may be further diluted and used in a coating composition or other metal working fluid and applied to metal components to reduce corrosion of the metal components. The disclosed compositions may be present at approximately 1 to 60 wt % in diluent oil or solvent for use as a coating composition or metal working fluid.

The disclosed compositions may also be used in hydraulic oil and industrial gear oil applications. Additional details on how the disclosed compositions may be used are described below.

Metal Working Fluid

In one embodiment the lubricant composition is a metal working fluid. Typical metal working fluid applications may include metal removal, metal forming, metal treating and metal protection, for example in a coating composition.

The coating compositions may also comprise a Group I, Group II or Group III or naphthenic basestock as defined by the American Petroleum Institute. In some embodiments, the coating composition may be mixed with Group IV or Group V basestock.

In some embodiments the coating compositions may include an oil. The oil may include most liquid hydrocarbons, for example, paraffinic, olefinic, naphthenic, aromatic, saturated or unsaturated hydrocarbons. In general, the oil is a water-immiscible, emulsifiable hydrocarbon, and in some embodiments the oil is liquid at room temperature. Oils from a variety of sources, including natural and synthetic oils and mixtures thereof may be used.

Natural oils include animal oils and vegetable oils (e.g., soybean oil, lard oil) as well as solvent-refined or acid-refined mineral oils of the paraffinic, naphthenic, or mixed paraffin-naphthenic types. Oils derived from coal or shale are also useful. Synthetic oils include hydrocarbon oils and halo-substituted hydrocarbon oils such as polymerized and inter-polymerized olefins e.g., polybutylenes, polypropylenes, propylene-isobutylene copolymers, chlorinated polybutylenes; alkyl benzenes e.g., dodecylbenzenes, tetradecylbenzenes, dinonylbenzenes, or di-(2-ethylhexyl) benzenes.

Another suitable class of synthetic oils that may be used comprises the esters of dicarboxylic acids (e.g., phthalic acid, succinic acid, alkyl succinic acid, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, pentaerythritol, etc.). Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, or a complex ester formed by reacting one mole of sebacic acid with two moles of tetraethylene glycol and two moles of 2-ethyl-hexanoic acid.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Unrefined, refined and rerefined oils (and mixtures of each with each other) of the type disclosed hereinabove may be used. Unrefined oils are those obtained directly from a natural or synthetic source without further purification treatment. For example, a shale oil obtained directly from a retorting operation, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such as solvent extraction, distillation, acid or base extraction, filtration, percolation, etc. Re-refined oils are obtained by processes similar to those used to obtain refined oils applied to refined oils which have been already used in service. Such re-refined oils are also known as reclaimed or reprocessed oils and often are additionally processed by techniques directed toward removal of spent additives and oil breakdown products.

Optional additional materials may be incorporated in the coating compositions disclosed herein. Typical finished coating compositions may include lubricity agents such as fatty acids and waxes, anti-wear agents, dispersants, corrosion inhibitors (in addition to the novel compositions disclosed herein), normal and overbased detergents, demulsifiers, biocidal agents, metal deactivators, defoamers, or mixtures thereof.

Example waxes include petroleum, synthetic, and natural waxes, oxidized waxes, microcrystalline waxes, wool grease (lanolin) and other waxy esters, and mixtures thereof. Petroleum waxes are paraffinic compounds isolated from crude oil via some refining process, such as slack wax and paraffin wax. Synthetic waxes are waxes derived from petrochemicals, such as ethylene or propylene. Synthetic waxes include polyethylene, polypropylene, and ethylene-propylene copolymers. Natural waxes are waxes produced by plants and/or animals or insects. These waxes include beeswax, soy wax and carnauba wax. Insect and animal waxes include beeswax, or spermaceti. Petrolatum and oxidized petrolatum may also be used in these compositions. Petrolatums and oxidized petrolatums may be defined, respectively, as purified mixtures of semisolid hydrocarbons derived from petroleum and their oxidation products. Microcrystalline waxes may be defined as higher melting point waxes purified from petrolatums. The wax(es) may be present in the metal working composition at from 0.1 wt % to 75 wt %, e.g., 0.1 wt % to 50 wt %.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof. As used herein the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

Friction modifiers may also encompass materials such as sulfurized fatty compounds and olefins, molybdenum dialkyldithiophosphates, molybdenum dithiocarbamates, or other oil soluble molybdenum complexes such as Molyvan® 855 (commercially available from R. T. Vanderbilt, Inc) or Sakuralube® S-700 or Sakuralube® S-710 (commercially available from Adeka, Inc). The oil soluble molybdenum complexes assist in lowering the friction, but may compromise seal compatibility.

In one embodiment the friction modifier may be an oil soluble molybdenum complex. The oil soluble molybdenum complex may include molybdenum dithiocarbamate, molybdenum dithiophosphate, molybdenum blue oxide complex or other oil soluble molybdenum complex or mixtures thereof. The oil soluble molybdenum complex may be a mix of molybdenum oxide and hydroxide, so called "blue" oxide. The molybdenum blue oxides have the molybdenum in a mean oxidation state of between 5 and 6 and are mixtures of $MoO_2(OH)$ to $MoO_{2.5}(OH)_{0.5}$. An example of the oil soluble is molybdenum blue oxide complex known by the tradename of Luvodor® MB or Luvador® MBO (commercially available from Lehmann and Voss GmbH), The oil soluble molybdenum complexes may be present at 0 wt % to 5 wt %, or 0.1 wt % to 5 wt % or 1 to 3 wt % of the metal-working composition.

In one embodiment the friction modifier may be a long chain fatty acid ester. In another embodiment the long chain fatty acid ester may be a mono-ester and in another embodiment the long chain fatty acid ester may be a triglyceride such as sunflower oil or soybean oil or the monoester of a polyol and an aliphatic carboxylic acid. The friction modifiers described above may be present at 0 wt % to 6 wt %, or 0.01 wt % to 4 wt %, or 0.05 wt % to 2 wt %, or 0.1 wt % to 2 wt % of the metal-working composition/coating composition.

Fatty acids useful herein include monocarboxylic acids of 8 to 35 carbon atoms, and in one embodiment 16 to 24 carbon atoms. Examples of such monocarboxylic acids include unsaturated fatty acids, such as myristoleic acid, palmitoleic acid, sapienic acid, oleic acid, elaidic acid, vaccenic acid, linoleic acid, linoelaidic acid; α-linolenic acid; arachidonic acid; eicosapentaenoic acid; erucic acid, docosahexaenoic acid; and saturated fatty acids, such as caprylic acid; capric acid; lauric acid, myristic acid; palmitic acid; stearic acid, arachidic acid, behenic acid; lignoceric acid, cerotic acid, isostearic acid, gadoleic acid, tall oil fatty acids, or combinations thereof. These acids may be saturated, unsaturated, or have other functional groups, such as hydroxy groups, as in 12-hydroxy stearic acid, from the hydrocarbyl backbone. Other example carboxylic acids are described in U.S. Pat. No. 7,435,707. The fatty acid(s) may be present in the metal working composition at from 0.1 wt % to 50 wt %, or 0.1 wt % to 25 wt %, or 0.1 wt % to 10 wt %.

Suitable metal detergents include the detergents described above. The metal detergents may be used alone or in combination. The metal detergents may be present in the range from 0.1 wt % to 20%; such as at least 1 wt % or up to 10 wt % of the composition.

Exemplary surfactants include nonionic polyoxyethylene surfactants such as ethoxylated alkyl phenols and ethoxylated aliphatic alcohols, polyethylene glycol esters of fatty, resin and tall oil acids and polyoxyethylene esters of fatty acids or anionic surfactants such as linear alkyl benzene sulfonates, alkyl sulfonates, alkyl ether phosphonates, ether sulfates, sulfosuccinates, and ether carboxylates. The surfactants(s) may be present in the metal working composition at from 0.0001 wt % to 10 wt %, or 0.0001 wt % to 2.5 wt %.

The antifoam agent may include organic silicones and non-silicon foam inhibitors. Examples of organic silicones include dimethyl silicone and polysiloxanes. Examples of non-silicon foam inhibitors include polyethers, polyacrylates and mixtures thereof as well as co-polymers of ethyl acrylate, 2-ethylhexylacrylate, and optionally vinyl acetate. In some embodiments the antifoam agent may be a polyacrylate. Antifoam agents may be present in the composition from 0.001 wt % or even 0.0025 wt % to 0.10 wt %.

Demulsifiers useful herein include polyethylene glycol, polyethylene oxides, polypropylene alcohol oxides (ethylene oxide-propylene oxide) polymers, polyoxyalkylene alcohol, alkyl amines, amino alcohol, diamines or polyamines reacted sequentially with ethylene oxide or substituted ethylene oxide mixtures, trialkyl phosphates, and combinations thereof. The demulsifier(s) may be present in the corrosion-inhibiting composition at from 0.0001 wt % to 10 wt %, e.g., 0.0001 wt % to 2.5 wt %

Other corrosion inhibitors in addition to the exemplary compounds may also be used in the compositions provided herein. The corrosion inhibitors which may be used include thiazoles, triazoles and thiadiazoles. Examples include benzotriazole, tolyltriazole, octyltriazole, decyltriazole, dodecyltriazole, 2-mercaptobenzothiazole, 2,5-dimercapto-1,3,4-thiadiatole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis-(hydrocarbyl-dithio)-1,3,4-thiadiazoles. Other suitable inhibitors of corrosion include ether amines; poly-ethoxylated compounds such as ethoxylated amines, ethoxylated phenols, and ethoxylated alcohols; imidazolines. Other suitable corrosion inhibitors include alkenylsuccinic acids in which the alkenyl group contains 10 or more carbon atoms such as, for example, tetrapropenylsuccinic acid, tetradecenylsuccinic acid, hexadecenylsuccinic acid; long-chain alpha, omega-dicarboxylic acids in the molecular weight range of 600 to 3000; and other similar materials. Other non-limiting examples of such inhibitors may be found in U.S. Pat. Nos. 3,873,465, 3,932,303, 4,066,398, 4,402,907, 4,971,724, 5,055,230, 5,275,744, 5,531,934, 5,611,991, 5,616,544, 5,344,069, 5,750,070, 5,779,938, and 5,785,896; Corrosion Inhibitors, C. C. Nathan, ed., NACE, 1973; 1. L. Rozenfeld, Corrosion Inhibitors, McGraw-Hill, 1981; Metals Handbook, $9^{th}$ Ed., Vol. 13—Corrosion, pp. 478497; Corrosion Inhibitors for Corrosion Control, B. G. Clubley, ed., The Royal Society of Chemistry, 1990; Corrosion Inhibitors, European Federation of Corrosion Publications Number 11, The Institute of Materials, 1994; Corrosion, Vol. 2—Corrosion Control, L. L. Sheir, R. A. Jarman, and G. T. Burstein, eds., Butterworth-Heinemann, 1994, pp. 17:10-17:39; Y. I. Kuznetsov, Organic Inhibitors of Corrosion of Metals, Plenum, 1996; and in V. S. Sastri, Corrosion Inhibitors: Principles and Applications, Wiley, 1998. The other corrosion inhibitor(s) may be present in the metal-working composition at from 0.0001 wt % to 5 wt %, e.g., 0.0001 wt % to 3 wt %.

Dispersants which may be included in the composition include those with an oil soluble polymeric hydrocarbon backbone and having functional groups that are capable of associating with particles to be dispersed. The polymeric hydrocarbon backbone may have a weight average molecular weight ranging from 750 to 1500 Daltons. Exemplary functional groups include amines, alcohols, amides, and ester polar moieties which are attached to the polymer backbone, often via a bridging group. Example dispersants include Mannich dispersants, described in U.S. Pat. Nos. 3,697,574 and 3,736,357; ashless succinimide dispersants described in U.S. Pat. Nos. 4,234,435 and 4,636,322; amine dispersants described in U.S. Pat. Nos. 3,219,666, 3,565,804, and 5,633,326; Koch dispersants, described in U.S. Pat. Nos. 5,936,041, 5,643,859, and 5,627,259, and polyalkylene succinimide dispersants, described in U.S. Pat. Nos. 5,851,965, 5,853,434, and 5,792,729. The dispersant(s) may be present in the metal-working composition at from 0.0001 wt % to 10 wt %, e.g., 0.0005 wt % to 2.5 wt %.

The extreme pressure agent may be a compound containing sulphur and/or phosphorus and/or chlorine. Examples of an extreme pressure agents include a polysulphide, a sulphurised olefin, a thiadiazole, chlorinated paraffins, overbased sulphonates or mixtures thereof.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydro-carbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically, readily available materials such as 2,5-dimercapto-1,3,4-thiadiazole or a hydrocarbyl-substituted 2,5-dimercapto-1,3,4-thiadiazole or a hydrocarbylthio-substituted 2,5-dimer-capto-1,3,4-thiadiazole are commonly utilised. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

In one embodiment at least 50 wt % of the polysulphide molecules are a mixture of tri- or tetra-sulphides. In other embodiments at least 55 wt %, or at least 60 wt % of the polysulphide molecules are a mixture of tri- or tetra-sulphides.

The polysulphide includes a sulphurised organic polysulphide from oils, fatty acids or ester, olefins or polyolefins.

Oils which may be sulphurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulphurised olefin includes an olefin derived from propylene, isobutylene, pentene or mixtures thereof.

In one embodiment the polysulphide comprises a polyolefin derived from polymerizing by known techniques an olefin as described above.

In one embodiment the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts.

Chlorinated paraffins may include both long chain chlorinate paraffins ($C_{20+}$ and medium chain chlorinated paraffins ($C_{14}$-$C_{17}$). Examples include Choroflo, Paroil and Chlorowax products from Dover Chemical.

Overbased sulphonates have been discussed above. Examples of overbased sulfonates include Lubrizol® 5283C, Lubrizol® 5318A, Lubrizol® 5347LC and Lubrizol® 5358.

The extreme pressure agent may be present at 0 wt % to 25 wt %, 1.0 wt % to 15.0 wt %, 2.0 wt % to 10.0 wt % of the metalworking composition.

The coating compositions may be prepared by further diluting the compositions in Table 1 above with solvent and/or diluent oil, such as API base oil, as described above. The coating compositions may be prepared by diluting the disclosed compositions with 5%, 6%, 10%, 20%, or even 70 to 90 wt % solvent or diluent oil based on a total weight of the coating composition. Suitable diluents include, naphthenic oil, mineral spirits, Group I paraffinic base oils, Group II paraffinic base oils, and Group II+ paraffinic base oil, or combinations thereof.

Coating compositions having the disclosed corrosion inhibiting compositions comprising a metal detergent and at least one hydrocarbyl-substituted carboxylic acid may be evaluated using the Salt Spray test as described in ASTM B 117.

Lubricant Compositions—Industrial Gear and Hydraulic Oils

The compositions disclosed include industrial additive packages, which may also be referred to as industrial lubricant additive packages. These industrial additive packages are designed to be used in lubricants for industrial gear and/or hydraulic oils. The lubricant composition may comprise an oil of lubricating viscosity. Such oils include natural oils and synthetic fluids, oil derived from hydrocracking, hydrogenation, and hydrofinishing, unrefined, refined, re-refined oils or mixtures thereof as described above. In some embodiments, the oil of lubricating viscosity comprises a Group I, Group II, Group II+ base oil, or combinations thereof.

In addition to the corrosion inhibitors disclosed herein, additives which may be present in the industrial additive package include a foam inhibitor, a demulsifier, a pour point depressant, an antioxidant, a dispersant, a metal deactivator (such as a copper deactivator), an antiwear agent, an extreme pressure agent, a viscosity modifier, or some mixture thereof. The additives may each be present in the range from 50 ppm, 75 ppm, 100 ppm or even 150 ppm up to 5 wt %, 4 wt %, 3 wt %, 2 wt % or even 1.5 wt %, or from 75 ppm to 0.5 wt %, from 100 ppm to 0.4 wt %, or from 150 ppm to 0.3 wt %, where the wt % values are with regards to the overall lubricant composition. In other embodiments the overall industrial additive package may be present from 1 to 20, or from 1 to 10 wt % of the overall lubricant composition. However, it is noted that some additives, including viscosity modifying polymers, which may alternatively be considered as part of the base fluid, may be present in higher amounts including up to 30 wt %, 40 wt %, or even 50 wt % when considered separate from the base fluid. The additives may be used alone or as mixtures thereof.

The lubricant may also include antifoam agent. The antifoam agent may include organic silicones and non-silicon foam inhibitors. Examples of organic silicones include dimethyl silicone and polysiloxanes. Examples of non-silicon foam inhibitors include polyethers, polyacrylates and mixtures thereof as well as copolymers of ethyl acrylate, 2-ethylhexylacrylate, and optionally vinyl acetate. In some embodiments the antifoam agent may be a polyacrylate. Antifoam agents may be present in the composition from 0.001 wt % to 0.012 wt % or 0.004 wt % or even 0.001 wt % to 0.003 wt %.

The lubricant may also include demulsifier. The demulsifier may include derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of a demulsifier include polyethylene glycols, polyethylene oxides, polypropylene oxides, (ethylene oxide-propylene oxide) polymers and mixtures thereof. The demulsifier may be a polyethers. The demulsifier may be present in the composition from 0.002 wt % to 0.2 wt %.

The lubricant may include a pour point depressant. The pour point depressant may include esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

The lubricant may also include a corrosion or rust inhibitor, other the corrosion inhibitor disclosed above. Suitable rust inhibitors include hydrocarbyl amine salts of alkylphosphoric acid, hydrocarbyl amine salts of dialkyldithiophosphoric acid, hydrocarbyl amine salts of hydrocarbyl aryl sulphonic acid, fatty carboxylic acids or esters thereof, an ester of a nitrogen-containing carboxylic acid, an ammonium sulfonate, an imidazoline, or any combination thereof; or mixtures thereof.

Suitable hydrocarbyl amine salts of alkylphosphoric acid may be represented by the following formula:

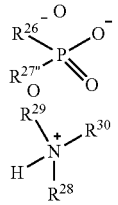

wherein $R^{26}$ and $R^{27}$ are independently hydrogen, alkyl chains or hydrocarbyl, typically at least one of $R^{26}$ and $R^{27}$ are hydrocarbyl. $R^{26}$ and $R^{27}$ contain 4 to 30, or 8 to 25, or 10 to 20, or 13 to 19 carbon atoms. $R^{28}$, $R^{29}$ and $R^{30}$ are independently hydrogen, alkyl branched or linear alkyl chains with 1 to 30, or 4 to 24, or 6 to 20, or 10 to 16 carbon atoms. $R^{28}$, $R^{29}$ and $R^{30}$ are independently hydrogen, alkyl branched or linear alkyl chains, or at least one, or two of $R^{28}$, $R^{29}$ and $R^{30}$ are hydrogen.

Examples of alkyl groups suitable for $R^{28}$, $R^{29}$ and $R^{30}$ include butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonadecyl, eicosyl or mixtures thereof.

In one embodiment the hydrocarbyl amine salt of an alkylphosphoric acid may be the reaction product of a $C_{14}$ to $C_{18}$ alkylated phosphoric acid with Primene 81R (produced and sold by Rohm & Haas) which may be a mixture of $C_{11}$ to $C_{14}$ tertiary alkyl primary amines.

Hydrocarbyl amine salts of dialkyldithiophosphoric acid may include a rust inhibitor such as a hydrocarbyl amine salt of dialkyldithiophosphoric acid. These may be a reaction product of heptyl or octyl or nonyl dithiophosphoric acids with ethylene diamine, morpholine or Primene 81R or mixtures thereof.

The hydrocarbyl amine salts of hydrocarbyl aryl sulphonic acid may include ethylene diamine salt of dinonyl naphthalene sulphonic acid.

Examples of suitable fatty carboxylic acids or esters thereof include glycerol monooleate and oleic acid. An example of a suitable ester of a nitrogen-containing carboxylic acid includes oleyl sarcosine.

The lubricant may contain a metal deactivator, or mixtures thereof. Metal deactivators may be chosen from a derivative of benzotriazole (typically tolyltriazole), 1,2,4-triatole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine. The metal deactivators may also be described as corrosion inhibitors. The metal deactivators may be present in the range from 0.001 wt % to 0.5 wt %, from 0.01 wt % to 0.04 wt % or from 0.015 wt % to 0.03 wt % of the lubricating oil composition. Metal deactivators may also be present in the composition from 0.002 wt % or 0.004 wt % to 0.02 wt %. The metal deactivator may be used alone or mixtures thereof.

The lubricants may also include antioxidant, or mixtures thereof. The antioxidants, including (i) an alkylated diphenylamine, and (ii) a substituted hydrocarbyl monosulfide. In some embodiments the alkylated diphenylamines include bis-nonylated diphenylamine and bis-octylated diphenylamine. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl monosulfide may be 1-(tert-dodecylthio)-2-propanol. The antioxidant package may also include sterically hindered phenols. Examples of suitable hydrocarbyl groups for the sterically hindered phenols include 2-ethylhexyl or n-butyl ester, dodecyl or mixtures thereof. Examples of methylene-bridged sterically hindered phenols include 4,4"-methylene-bis(6-tert-butyl o-cresol), 4,4'-methylene-bis(2-tert-amyl-o-cresol), 2,2'-methylene-bis(4-methyl-6-tert-butylphenol), 4,4'-methylene-bis(2,6-di-tertbutylphenol) or mixtures thereof.

The antioxidants may be present in the composition from 0.01 wt % to 6.0 wt % or from 0.02 wt % to 1 wt %. The additive may be present in the composition at 1 wt %, 0.5 wt %, or less.

The lubricant may also include nitrogen-containing dispersants, for example a hydrocarbyl substituted nitrogen containing additive. Suitable hydrocarbyl substituted nitrogen containing additives include ashless dispersants and polymeric dispersants. Ashless dispersants are so-named because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Examples of such materials include succinimide dispersants, Mannich dispersants, and borated derivatives thereof.

The lubricant may also include sulfur-containing compounds. Suitable sulfur-containing compounds include sulfurized olefins and polysulfides. The sulfurized olefin or polysulfides may be derived from isobutylene, butylene, propylene, ethylene, or some combination thereof. In some examples the sulfur-containing compound is a sulfurized olefin derived from any of the natural oils or synthetic oils described above, or even some combination thereof. For example, the sulfurized olefin may be derived from vegetable oil. The sulfurized olefin may be present in the lubricant composition from 0 wt % to 5.0 wt % or from 0.01 wt % to 4.0 wt % or from 0.1 wt % to 3.0 wt %.

The lubricant may also include phosphorus containing compound, such as a fatty phosphite. The phosphorus containing compound may include a hydrocarbyl phosphite, a phosphoric acid ester, an amine salt of a phosphoric acid ester, or any combination thereof. In some embodiments the phosphorus containing compound includes a hydrocarbyl phosphite, an ester thereof, or a combination thereof. In some embodiments the phosphorus containing compound includes a hydrocarbyl phosphite. In some embodiments the hydrocarbyl phosphite may be an alkyl phosphite. By alkyl it is meant an alkyl group containing only carbon and hydrogen atoms, however either saturated or unsaturated alkyl groups are contemplated or mixtures thereof. In some embodiments the phosphorus containing compound includes an alkyl phosphite that has a fully saturated alkyl group. In some embodiments the phosphorus containing compound includes an alkyl phosphite that has an alkyl group with some unsaturation, for example, one double bond between carbon atoms. Such unsaturated alkyl groups may also be referred to as alkenyl groups, but are included within the term "alkyl group" as used herein unless otherwise noted. In some embodiments the phosphorus containing compound includes an alkyl phosphite, a phosphoric acid ester, an amine salt of a phosphoric acid ester, or any combination thereof. In some embodiments the phosphorus containing compound includes an alkyl phosphite, an ester thereof, or a combination thereof. In some embodiments the phosphorus containing compound includes an alkyl phosphite. In some embodiments the phosphorus containing compound includes an alkenyl phosphite, a phosphoric acid ester, an amine salt of a phosphoric acid ester, or any combination thereof. In some embodiments the phosphorus containing compound includes an alkenyl phosphite, an ester thereof, or a combination thereof. In some embodiments the phosphorus containing compound includes an alkenyl phosphite. In some embodiments the phosphorus containing compound includes dialkyl hydrogen phosphites. In some embodiments the phosphorus-containing compound is essentially free of, or even completely free of, phosphoric acid esters and/or amine salts thereof. In some embodiments the phosphorus-containing compound may be described as a fatty phosphite. Suitable phosphites include those having at least one hydrocarbyl group with 4 or more, or 8 or more, or 12 or more, carbon atoms. Typical ranges for the number of carbon atoms on the hydrocarbyl group include 8 to 30, or 10 to 24, or 12 to 22, or 14 to 20, or 16 to 18. The phosphite may be a mono-hydrocarbyl substituted phosphite, a di-hydrocarbyl substituted phosphite, or a tri-hydrocarbyl substituted phosphite. In one embodiment the phosphite may be sulphur-free i.e., the phosphite is not a thiophosphite. The phosphite having at least one hydrocarbyl group with 4 or more carbon atoms may be represented by the formulae:

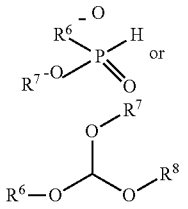

wherein at least one of $R^6$, $R^7$ and $R^8$ may be a hydrocarbyl group containing at least 4 carbon atoms and the other may be hydrogen or a hydrocarbyl group. In one embodiment $R^6$, $R^7$ and $R^8$ are all hydrocarbyl groups. The hydrocarbyl groups may be alkyl, cycloalkyl, aryl, acyclic or mixtures thereof. In the formula with all three groups $R^6$, $R^7$ and $R^8$, the compound may be a tri-hydrocarbyl substituted phosphite i.e., $R^6$, $R^7$ and $R^8$ are all hydrocarbyl groups and in some embodiments may be alkyl groups.

The alkyl groups may be linear or branched, typically linear, and saturated or unsaturated, typically saturated. Examples of alkyl groups for $R^6$, $R^7$ and $R^8$ include octyl, 2-ethylhexyl, nonyl, decyl, undecyl, dodecyl, tridecyl, tetradecyl, pentadecyl, hexadecyl, heptadecyl, octadecyl, octadecenyl, nonadecyl, eicosyl or mixtures thereof. In some embodiments the fatty phosphite component the lubricant composition overall is essentially free of, or even completely free of phosphoric acid ester and/or amine salts thereof. In some embodiments the fatty phosphite comprises an alkenyl phosphite or esters thereof, for example esters of dimethyl hydrogen phosphite. The dimethyl hydrogen phosphite may be esterified, and in some embodiments transesterified, by reaction with an alcohol, for example oleyl alcohol.

The lubricant may also include one or more phosphorous amine salts, but in amounts such that the additive package, or in other embodiments the resulting industrial lubricant compositions, contains no more than 1.0 wt % of such materials, or even no more than 0.75 wt % or 0.6 wt %. In other embodiments the industrial lubricant additive packages, or the resulting industrial lubricant compositions, are essentially free of or even completely free of phosphorous amine salts.

The lubricant may also include one or more antiwear additives and/or extreme pressure agents, one or more rust and/or corrosion inhibitors, one or more foam inhibitors, one or more demulsifiers, or any combination thereof.

In some embodiments the industrial lubricant additive packages, or the resulting industrial lubricant compositions, are essentially free of or even completely free of phosphorous amine salts, dispersants, or both.

In some embodiments the industrial lubricant additive packages, or the resulting industrial lubricant compositions, include a demulsifier, a corrosion inhibitor, a friction modifier, or combination of two or more thereof. In some embodiments the corrosion inhibitor includes a tolyltriazole. In still other embodiments the industrial additive packages, or the resulting industrial lubricant compositions, include one or more sulfurized olefins or polysulfides; one or more phosphorus amine salts; one or more thiophosphate esters, one or more thiadiazoles, tolyltriazoles, polyethers, and/or alkenyl amines; one or more ester copolymers; one or more carboxylic esters; one or more succinimide dispersants, or any combination thereof.

The industrial lubricant additive package may be present in the overall industrial lubricant from 1 wt % to 5 wt %, or in other embodiments from 1 wt %, 1.5 wt %, or even 2 wt % up to 2 wt %, 3 wt %, 4 wt %, 5 wt %, 7 wt % or even 10 wt %. Amounts of the industrial gear additive package that may be present in the industrial gear concentrate lubricant are the corresponding amounts to the wt % above, where the values are considered without the oil present (i.e. they may be treated as wt % values along with the actual amount of oil present).

The lubricant may also include a derivative of a hydroxy-carboxylic acid. Suitable acids may include from 1 to 5 or 2 carboxy groups or from 1 to 5 or 2 hydroxy groups. In some embodiments the friction modifier may be derivable from a hydroxy-carboxylic acid represented by the formula:

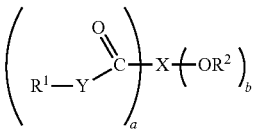

wherein: a and b may be independently integers of 1 to 5, or 1 to 2; X may be an aliphatic or alicyclic group, or an aliphatic or alicyclic group containing an oxygen atom in the carbon chain, or a substituted group of the foregoing types, said group containing up to 6 carbon atoms and having a+b available points of attachment; each Y may be independently —O—, >NH, or >$NR^3$ or two Y's together representing the nitrogen of an imide structure $R^4$—N< formed between two carbonyl groups; and each $R^3$ and $R^4$ may be independently hydrogen or a hydrocarbyl group, provided that at least one $R^1$ and $R^3$ group may be a hydrocarbyl group; each $R^2$ may be independently hydrogen, a hydrocarbyl group or an acyl group, further provided that at least one —$OR^2$ group is located on a carbon atom within X that is α or β to at least one of the —C(O)—Y—R' groups, and further provided that at least on $R^2$ is hydrogen. The hydroxy-carboxylic acid is reacted with an alcohol and/or an amine, via a condensation reaction, forming the derivative of a hydroxy-carboxylic acid, which may also be referred to herein as a friction modifier additive. In one embodiment the hydroxy-carboxylic acid used in the preparation of the derivative of a hydroxy-carboxylic acid is represented by the formula:

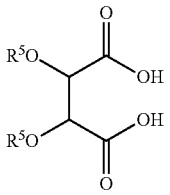

wherein each $R^5$ may independently be H or a hydrocarbyl group, or wherein the $R^5$ groups together form a ring. In one embodiment, where $R^5$ is H, the condensation product is optionally further functionalized by acylation or reaction with a boron compound. In another embodiment the friction modifier is not borated. In any of the embodiments above, the hydroxy-carboxylic acid may be tartaric acid, citric acid, or combinations thereof, and may also be a reactive equivalent of such acids (including esters, acid halides, or anhydrides).

The resulting friction modifiers may include imide, di-ester, di-amide, or ester-amide derivatives of tartaric acid, citric acid, or mixtures thereof. In one embodiment the derivative of hydroxycarboxylic acid includes an imide, a di-ester, a di-amide, an imide amide, an imide ester or an ester-amide derivative of tartaric acid or citric acid. In one embodiment the derivative of hydroxycarboxylic acid includes an imide, a di-ester, a di-amide, an imide amide, an imide ester or an ester-amide derivative of tartaric acid. In one embodiment the derivative of hydroxycarboxylic acid includes an ester derivative of tartaric acid. In one embodiment the derivative of hydroxycarboxylic acid includes an imide and/or amide derivative of tartaric acid. The amines used in the preparation of the friction modifier may have the formula RR'NH wherein R and R' each independently represent H, a hydrocarbon-based radical of 1 or 8 to 30 or 150 carbon atoms, that is, 1 to 150 or 8 to 30 or 1 to 30 or 8 to 150 atoms. Amines having a range of carbon atoms with a lower limit of 2, 3, 4, 6, 10, or 12 carbon atoms and an upper limit of 120, 80, 48, 24, 20, 18, or 16 carbon atoms may also be used. In one embodiment, each of the groups R and R' has 8 or 6 to 30 or 12 carbon atoms. In one embodiment, the sum of carbon atoms in R and R' is at least 8. R and R' may be linear or branched. The alcohols useful for preparing the friction modifier will similarly contain 1 or 8 to 30 or 150 carbon atoms. Alcohols having a range of carbon atoms from a lower limit of 2, 3, 4, 6, 10, or 12 carbon atoms and an upper limit of 120, 80, 48, 24, 20, 18, or 16 carbon atoms may also be used. In certain embodiments the number of carbon atoms in the alcohol-derived group may be 8 to 24, 10 to 18, 12 to 16, or 13 carbon atoms. The alcohols and amines may be linear or branched, and, if branched, the branching may occur at any point in the chain and the branching may be of any length. In some embodiments the alcohols and/or amines used include branched compounds, and in still other embodiments, the alcohols and amines used are at least 50%, 75% or even 80% branched. In other embodiments the alcohols are linear. In some embodiments, the alcohol and/or amine have at least 6 carbon atoms. Accordingly, certain embodiments the product prepared from branched alcohols and/or amines of at least 6 carbon atoms, for instance, branched $C_{6-18}$ or $C_{8-18}$ alcohols or branched $C_{12-16}$ alcohols, either as single materials or as mixtures. Specific examples include 2-ethylhexanol and isotridecyl alcohol, the latter of which may represent a commercial grade mixture of various isomers. Also, certain embodiments the product prepared from linear alcohols of at least 6 carbon atoms, for instance, linear $C_{6-18}$ or $C_{8-18}$ alcohols or linear $C_{12-16}$ alcohols, either as single materials or as mixtures. The tartaric acid used for preparing the tartrates, tartrimides, or tartramides may be the commercially available type (obtained from Sargent Wech), and it exists in one or more isomeric forms such as d-tartaric acid, l-tartaric acid, d,l-tartaric acid or meso-tartaric acid, often depending on the source (natural) or method of synthesis (e.g. from maleic acid). These derivatives may also be prepared from functional equivalents to the diacid readily apparent to those skilled in the art, such as esters, acid chlorides, or anhydrides.

In some embodiments the additive package includes one or more corrosion inhibitors, one or more dispersants, one or more antiwear and/or extreme pressure additives, one or more extreme pressure agents, one or more antifoam agents, one or more detergents, and optionally some amount of base oil or similar solvent as a diluent.

The additional additives may be present in the overall industrial gear lubricant composition from 0.1 wt % to 30 wt %, or from a minimum level of 0.1 wt %, 1 wt % or even 2 wt % up to a maximum of 30 wt %, 20 wt %, 10 wt %, 5 wt %, or even 2 wt %, or from 0.1 wt % to 30 wt %, from 0.1 wt % to 20 wt %, from 1 wt % to 20 wt %, from 1 wt % to 10 wt %, from 1 wt % to 5 wt %, or even about 2 wt %. These ranges and limits may be applied to each individual additional additive present in the composition, or to all of the additional additives present.

The Industrial Gear lubricant may comprise:

0.01 wt % to 5 wt % of a phos-amine salt, 0.0001 wt % to 0.15 wt % of the disclosed corrosion inhibitors, alone or used in combination with 2,5-bis (tert-dodecyldithio)-1,3,4-thiadiazole, tolyltriazole, or mixtures thereof, an oil of lubricating viscosity, 0.02 wt % to 3 wt % of antioxidant chosen from aminic or phenolic antioxidants, or mixtures thereof, 0.005 wt % to 1.5 wt % of a borated succinimide or a non-borated succinimide, 0.001 wt % to 1.5 wt % of a neutral or slightly overbased calcium naphthalene sulphonate (typically a neutral or slightly overbased calcium dinonyl naphthalene sulphonate), and 0.001 wt % to 2 wt %, or 0.01 wt % to 1 wt % of an antiwear agent chosen from zinc dialkyldithiophosphate, zinc dialkylphosphate, amine salt of a phosphorus acid or ester, or mixtures thereof.

The Industrial Gear lubricant may also comprise a formulation defined in the following table:

Industrial Gear Lubricant compositions

| | Embodiments (wt %) | | |
|---|---|---|---|
| Additive | A | B | C |
| Disclosed Corrosion Inhibitor | 0.001 to 1.0 | 0.005 to 0.5 | 0.01 to 0.25 |
| Sulfurized Olefin | 0 to 5.0 | 0.01 to 4.0 | 0.1 to 3 |
| Dispersant | 0 to 2.0 | 0.005 to 1.5 | 0.01 to 1.0 |
| Antifoam Agent | 0.001 to 0.012 | 0.001 to 0.004 | 0.001 to 0.003 |
| Demulsifier | 0.002 to 2 | .0025 to 0.5 | 0.005 to 0.04 |
| Metal Deactivator | 0.001 to 0.5 | 0.01 to 0.04 | 0.015 to 0.03 |
| Amine Phosphate | 0 to 3.0 | 0.005 to 2 | 0.01 to 1.0 |
| Oil of Lubricating Viscosity | Balance to 100% | Balance to 100% | Balance to 100% |

Antiwear performance of each lubricant may be evaluated in accordance with ASTM D2782-02(2008) Standard Test Method for Measurement of Extreme-Pressure Properties of Lubricating Fluids (Timken Method), ASTM D2783-03 (2009) Standard Test Method for Measurement of Extreme-Pressure Properties of Lubricating Fluids (Four-Ball Method), ASTM D4172-94(2010) Standard Test Method for Wear Preventive Characteristics of Lubricating Fluid (Four-Ball Method) and ASTM D5182-97(2014) Standard Test Method for Evaluating the Scuffing Load Capacity of Oils (FZG Visual Method).

The hydraulic lubricant may comprise:

0.01 wt % to 3 wt % of a phos-amine salt, 0.0001 wt % to 0.15 wt % of the disclosed corrosion inhibitors, alone or used in combination with 2,5-bis (tert-dodecyldithio)-1,3,4-thiadiazole, tolyltriazole, or mixtures thereof, an oil of lubricating viscosity, 0.02 wt % to 3 wt % of antioxidant chosen from aminic or phenolic antioxidants, or mixtures thereof, 0.005 wt % to 1.5 wt % of a borated succinimide or a non-borated succinimide, 0.001 wt % to 1.5 wt % of a neutral of slightly overbased calcium naphthalene sulphonate (typically a neutral or slightly overbased calcium dinonyl naphthalene sulphonate), and 0.001 wt % to 2 wt %, or 0.01 wt % to 1 wt % of an antiwear agent (other than the protic salt of the present invention) chosen from zinc dialkyldithiophosphate, zinc dialkylphosphate, amine salt of a phosphorus acid or ester, or mixtures thereof.

The hydraulic lubricant may also comprise a formulation defined in the following table:

Hydraulic Lubricant compositions

| Additive | Embodiments (wt %) A | B | C |
|---|---|---|---|
| Disclosed Corrosion Inhibitor | 0 to 0.2 | 0.03 to 0.15 | 0.04 to 0.12 |
| Antioxidant | 0 to 4.0 | 0.02 to 3.0 | 0.03 to 1.5 |
| Dispersant | 0 to 2.0 | 0.005 to 1.5 | 0.01 to 1.0 |
| Detergent | 0 to 5.0 | 0.001 to 1.5 | 0.005 to 1.0 |
| Antiwear Agent | 0 to 5.0 | 0.001 to 2 | 0.1 to 1.0 |
| Friction Modifier | 0 to 3.0 | 0.02 to 2 | 0.05 to 1.0 |
| Viscosity Modifier | 0 to 10.0 | 0.5 to 8.0 | 1.0 to 6.0 |
| Any Other Performance Additive (antifoam/demulsifier/pour point depressant) | 0 to 1.3 | 0.00075 to 0.5 | 0.001 to 0.4 |
| Metal Deactivator | 0 to 0.1 | 0.01 to 0.04 | 0.015 to 0.03 |
| Extreme Pressure Agent | 0 to 3.0 | 0.005 to 2 | 0.01 to 1.0 |
| Oil of Lubricating Viscosity | Balance to 100% | Balance to 100% | Balance to 100% |

Antiwear performance of each lubricant may be evaluated in accordance with ASTM D6973-08e1 Standard Test Method for Indicating Wear Characteristics of Petroleum Hydraulic Fluids in a High Pressure Constant Volume Vane Pump. Antiwear performance may also be evaluated utilizing a standard Falex Block-on-Ring wear and friction test machine. In this test, a standard test block is modified to accept a piece of actual 35VQ pump vain. The vane is in contact with a standard Falex ring in which a load is applied to the fixed vane and the ring rotates. The screen test runs at a similar load, sliding speed and oil temperature conditions as seen in standard 35VQ pump test. The mass of the test vane and ring are measured before and after the test. Performance is judge by the total amount of mass loss measured.

Greases

In one embodiment, lubricant may be used in a grease. The grease may have a composition comprising an oil of lubricating viscosity, a grease thickener, and the corrosion inhibiting composition disclosed herein.

In one embodiment, the grease may also be a sulphonate grease. Such greases are known in the art. In another embodiment, the sulphonate grease may be a calcium sulphonate grease prepared from overbasing a neutral calcium sulphonate to form amorphous calcium carbonate and subsequently converting it into either calcite, or vaterite or mixtures thereof.

The grease thickener may be any grease thickener known in the art. Suitable grease thickeners include, but are not limited to, metal salts of a carboxylic acid, metal soap grease thickeners, mixed alkali soaps, complex soaps, non-soap grease thickeners, metal salts of such acid-functionalized oils, polyurea and diurea grease thickeners, or calcium sulphonate grease thickeners. Other suitable grease thickeners include, polymer thickening agents, such as polytetrafluoroethylene, polystyrenes, and olefin polymers.

Inorganic grease thickeners may also be used. Exemplary inorganic thickeners include clays, organo-clays, silicas, calcium carbonates, carbon black, pigments or copper phthalocyanine. Further thickeners include urea derivatives, such as polyuria or a diurea. Specific examples of a grease include those summarized in the following table:

Grease Additive Package Compositions*

| Function/Component | Embodiments (wt %) Multi-functional | High Temp-Long Life |
|---|---|---|
| Disclosed Corrosion Inhibitors | 1.0 to 5.0 | 30.0 to 40.0 |
| Antioxidant | 10 to 20 | 25.0-60.0 |
| Dispersant | 0.50 to 5.0 | |
| Metal Deactivator | 1.0 to 8.0 | |
| Antiwear Agent | | 5.0 to 15.0 |
| Extreme Pressure Agent | 45.0 to 65.0 | 0.1 to 10.0 |
| Diluent Oil | Balance to 100% | Balance to 100% |

*The grease additive package is treated at 2 wt % to 5 wt % of a grease composition.

In order to demonstrate improved performance in a grease composition, the composition may be evaluated versus control standards as to ASTM D1743 Standard Test Method for Determining Corrosion Preventive Properties of Lubricating Greases, ASTM D5969-11e: Standard Test Method for Corrosion-Preventive Properties of Lubricating Greases in Presence of Dilute Synthetic Sea Water Environments and ASTM D6138-13: Standard Test Method for Determination of Corrosion-Preventive Properties of Lubricating Greases Under Dynamic Wet Conditions (Emcor Test).

These amounts disclosed in the tables above are calculated on an actives basis and exclusive of any oil or volatile diluent that may be present with the metal detergent and/or carboxylic acid. That is, one of the ways in which the present technology may be employed is by preparing an initial mixture of the components described herein, without the presence of an optional volatile diluent, or with its presence only in small amounts such as up to 10 percent or 5 percent or 2 percent or 1 percent or 0.1 percent by weight of the composition. For this reason, the amounts of the other components may be expressed as a percentage of the composition exclusive of the amount of the optional volatile diluent. It is in this form (volatile diluent- or solvent-free) that the materials of the disclosed technology may often be commercially prepared and distributed. However, the diluent-free material may have a viscosity that is unsuitable for easy handling, so addition of a volatile diluent may be desirable before the composition is applied as a coating to a substrate. If, at the time of application of the coating, a diluent is present, then the actual amounts of the other components can be calculated to take into account the presence of the diluent.

*****] The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

*****] It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The invention herein is useful for inhibiting corrosion of metal objects, which may be better understood with reference to the following examples.

Examples

The disclosed compositions may be prepared by mixing a metal detergent with at least on carboxylic, wherein the weight ratio of the metal detergent a) to the acid b) may range from 50:1 to 1:10, or 25:1 to 1:10, or 10:1 to 1:10, or 5:1 to 1:7, or 2:1 to 1:3. In some embodiments, the disclosed composition may comprise a) a calcium sulfonate detergent and b) an acid mixture comprising alkylbenzene sulfonic acid, a $C_{36}$ dimer carboxylic acid and oleic acid. The weight ratio of the alkylbenzene sulfonic acid to the carboxylic acids may range from 7:1 to 10:1. The ratio of the polycarboxylic acid (for example, a $C_{36}$ dimer carboxylic acid) to the monocarboxylic acid (for example oleic acid) may range from 1:3 to 1:0 to 3:1. In yet other embodiments, the ratio of the polycarboxylic acid to the monocarboxylic acid may range from 2.5:1 to 3:1.

Various compositions were prepared and tested for performance. The general preparation of the examples is as follows. Diluent oil and over-based calcium sulfonate are charged to a reactor and heated under agitation to 50±5° C. To this heated mixture, alkylbenzenesulfonic acid is added in several portions over 30-60 minutes to control foaming. Carboxylic acids are then charged and the temperature is increased to 130±5° C. The mixture is agitated at elevated temperature under a slow gas purge until no more water is collected (typically 3-4 hours). The material is then cooled to less than 100° C. and filtered through an appropriate filter media.

To prepare and coating compositions and test salt spray performance, the examples are diluted in the desired diluent (e.g. mineral spirits or naphthenic oil) at the desired concentration (5-20%) and agitated to homogenize the fluid. Gentle heating (40-50° C.) may be required to fully dilute materials with higher viscosity. Test dilutions are placed in a shallow pan. A steel panel is dipped into the test dilution for 60 seconds and then suspended in ambient air for 24 hours to dry. The typical thickness of the dipped coatings is 1-4 microns.

The dipped panels are then subjected to the Salt Spray test as described in ASTM B 117. Hours to failure is the time at which at least 5% of the treated surface shows rust as described in ASTM D610. Two numbers are given for each sample, the first being the last hour of passing and the second being the first hour of failure. Multiple entries represent multiple runs.

TABLE 1

Comparative Coating Compositions

| | Comp 1 | Comp 2 | Comp 3 |
|---|---|---|---|
| BLENDS/EXAMPLES: | | | |
| 300 TBN OVERBASED Ca SULFONATE | 25.00 | 14.10 | 30.00 |
| ALKYLBENZENESULFONIC ACID | 25.30 | 33.00 | 19.00 |
| CARBOXYLIC DIMER ACID | | 3.75 | |
| ADIPIC ACID | | | 3.75 |
| OLEIC ACID | 5.00 | 1.25 | 1.25 |
| NAPHTHENIC DILUENT OIL | 44.70 | 47.90 | 46.00 |
| Actives Content (%) | 40 | 40 | 40 |
| Metal Detergent:acid ratio (carboxylic and sulfonic) | 1:2 | 1:4.5 | 1:1.3 |
| Sulfonic:Carboxylic Acid Ratio | 7:1 | 7:1 | 7:1 |
| Total % Carboxylic Acid (%) | 5.0 | 5.0 | 5.0 |
| Polyacid:Monoacid Ratio | 0:1 | 3:1 | 3:1 |
| TBN (TOTAL BASE NUMBER), mg KOH/g | 51 | 9 | 73 |
| PERFORMANCE RESULTS: SALT SPRAY HOURS | | | |
| 20% DILUTION IN MINERAL SPIRITS | 56-72 | <72 | <64 |
| 15% DILUTION IN MINERAL SPIRITS | 56-72 | <72 | <64 |
| 10% DILUTION IN MINERAL SPIRITS | | | |
| 5% DILUTION IN MINERAL SPIRITS | | | |
| 20% DILUTION IN NAPHTHENIC | 8-24 | 24-32 | <8 |
| DILUENT OIL | 8-24 | 24-32 | <8 |

TABLE 2a

Inventive Coatins Comoositions

| | 1 | 2 | 3 | 4 | 5 |
|---|---|---|---|---|---|
| BLENDS/EXAMPLES: | | | | | |
| 300 TBN OVERBASED Ca SULFONATE | 25.00 | 35.00 | 25.00 | 30.00 | 30.00 |
| ALKYLBENZENESULFONIC ACID | 25.00 | 55.00 | 25.30 | 40.00 | 39.00 |
| CARBOXYLIC DIMER ACID | 5.00 | 2.50 | 3.75 | 3.75 | 3.75 |
| TRICARBOXYLIC ACID | | | | | |
| ADIPIC ACID | | | | | |
| OLEIC ACID | | 2.50 | 1.35 | 1.25 | 1.25 |
| NEODECANOIC ACID | | | | | |
| COCOA FATTY ACID | | | | | |
| HYDROXYALKYL CARBOXYLIC ACID-ESTER | | | | | |
| NAPHTHENIC DILUENT OIL | 45.00 | 5.00 | 44.60 | 25.00 | |
| PARAFFINIC DILUENT OIL | | | | | 26.00 |
| Actives Content (%) | 40 | 70 | 40 | 55 | 55 |
| Metal Detergent:acid ratio (carboxylic and sulfonic) | 1:2 | 1:2.9 | 1:2 | 1:2.5 | 1:2.4 |
| Sulfonic:Carboxylic Acid Ratio | 7:1 | 13:1 | 7:1 | 10:1 | 10:1 |
| Total % Carboxylic Acid (%) | 5.0 | 5.0 | 5.1 | 5.0 | 5.0 |
| Polyacid:Monoacid Ratio | 1:0 | 1:1 | 2.7:1 | 3:1 | 3:1 |
| TBN (TOTAL BASE NUMBER), mg KOH/g | 51 | 51 | 50 | 51 | 52 |

TABLE 2a-continued

| Inventive Coatins Comoositions | | | | | |
|---|---|---|---|---|---|
| | 1 | 2 | 3 | 4 | 5 |
| PERFORMANCE RESULTS: SALT SPRAY HOURS | | | | | |
| 20% DILUTION IN MINERAL SPIRITS | 488-504 | 328-336 | 240-256 | 328-336 | 232-240 |
| | 456-464 | 288-304 | 264-280 | 288-304 | 328-336 |
| 15% DILUTION IN MINERAL SPIRITS | 344-360 | | 224-240 | | |
| | 408-416 | | 336-344 | | |
| 10% DILUTION IN MINERAL SPIRITS | 248-312 | | 168-176 | | |
| | 248-312 | | 168-176 | | |
| 5% DILUTION IN MINERAL SPIRITS | 8-24 | | 8-24 | | |
| | 8-24 | | 8-24 | | |
| 20% DILUTION IN NAPHTHENIC DILUENT OIL | 56-72 | 48-56 | 72-80 | 72-80 | 48-56 |
| | 72-80 | 56-72 | 72-80 | 72-80 | 72-80 |

TABLE 2b

| Inventive Coating Compositions | | | | | |
|---|---|---|---|---|---|
| | 6 | 7 | 8 | 9 | 10 |
| BLENDS/EXAMPLES: | | | | | |
| 300 TBN OVERBASED Ca SULFONATE | 31.00 | 26.50 | 25.50 | 25.50 | 25.00 |
| ALKYLBENZENESULFONIC ACID | 20.00 | 24.00 | 22.00 | 22.00 | 25.00 |
| CARBOXYLIC DIMER ACID | 3.75 | | 5.625 | 5.625 | 3.75 |
| TRICARBOXYLIC ACID | | 3.75 | | | |
| ADIPIC ACID | | | | | |
| OLEIC ACID | 1.25 | 1.25 | | | |
| NEODECANOIC ACID | | | 1.875 | | |
| COCOA FATTY ACID | | | | 1.875 | |
| HYDROXYALKYL CARBOXYLIC ACID-ESTER | | | | | 1.25 |
| NAPHTHENIC DILUENT OIL | 44.00 | 44.50 | 45.00 | 45.00 | 45.00 |
| PARAFFINIC DILUENT OIL | | | | | |
| Actives Content (%) | 40 | 40 | 40 | 40 | 40 |
| Metal Detergent:acid ratio (carboxylic and sulfonic) | 1:1.3 | 1:1.8 | 1:1.9 | 1:1.9 | 1:2 |
| Sulfonic:Carboxylic Acid Ratio | 7:1 | 7:1 | 4:1 | 4:1 | 7:1 |
| Total % Carboxylic Acid (%) | 5.0 | 5.0 | 7.5 | 7.5 | 5.0 |
| Polyacid:Monoacid Ratio | 3:1 | 3:1 | 3:1 | 3:1 | 3:1 |
| TBN (TOTAL BASE NUMBER), mg KOH/g | 74 | 61 | 55 | 55 | 51 |
| PERFORMANCE RESULTS: SALT SPRAY HOURS | | | | | |
| 20% DILUTION IN MINERAL SPIRITS | 16-24 | 232-240 | 328-336 | 336-400 | 312-328 |
| | 16-24 | 264-280 | 344-360 | 288-304 | 400-408 |
| 15% DILUTION IN MINERAL SPIRITS | | | | | |
| 10% DILUTION IN MINERAL SPIRITS | | | | | |
| 5% DILUTION IN MINERAL SPIRITS | | | | | |
| 20% DILUTION IN NAPHTHENIC DILUENT OIL | 56-72 | 24-32 | 64-72 | 32-48 | 72-80 |
| | 56-72 | 32-48 | 72-88 | 72-88 | 56-72 |

TABLE 2c

| Inventive Coating Compositions | | | |
|---|---|---|---|
| | 11 | 12 | 13 |
| BLENDS/EXAMPLES: | | | |
| 300 TBN OVERBASED Ca SULFONATE | 25.00 | 27.00 | 19.00 |
| ALKYLBENZENESULFONIC ACID | 29.00 | 14.00 | 7.00 |
| CARBOXYLIC DIMER ACID | 2.500 | 3.750 | 3.750 |
| TRICARBOXYLIC ACID | | | |
| ADIPIC ACID | | | |
| OLEIC ACID | | 10.25 | 1.25 |
| NEODECANOIC ACID | | | |
| COCOA FATTY ACID | | | |
| HYDROXYALKYL CARBOXYLIC ACID-ESTER | | | |

TABLE 2c-continued

| Inventive Coating Compositions | 11 | 12 | 13 |
|---|---|---|---|
| NAPHTHENIC DILUENT OIL | 43.50 | 45.00 | 69.00 |
| PARAFFINIC DILUENT OIL | | | |
| Actives Content (%) | 40 | 40 | 20 |
| Metal Detergent:acid ratio (carboxylic and sulfonic) | 1:2.1 | 1:1.7 | 1:1.1 |
| Sulfonic:Carboxylic Acid Ratio | 15:1 | 2:1 | 3.3:1 |
| Total % Carboxylic Acid (%) | 2.5 | 14.0 | 5.0 |
| Polyacid:Monoacid Ratio | 1:0 | 1:2.75 | 3:1 |
| TBN (TOTAL BASE NUMBER), mg KOH/g | 46 | — | 51 |
| PERFORMANCE RESULTS: SALT SPRAY HOURS | | | |
| 20% DILUTION IN MINERAL SPIRITS | 304-312 | — | 128-144 |
| | 312-328 | — | 152-168 |
| 15% DILUTION IN MINERAL SPIRITS | | | |
| 10% DILUTION IN MINERAL SPIRITS | | | |
| 5% DILUTION IN MINERAL SPIRITS | | | |
| 20% DILUTION IN NAPHTHENIC | 8-24 | — | 0-8 |
| DILUENT OIL | 56-72 | — | 8-24 |

The above examples show the disclosed compositions have good salt spray performance, though the performance may vary depending on the solvent/diluent oil used. Examples 3 and 4 perform are readily soluble and have good salt spray performance in both mineral spirit and naphthenic oil dilutions. Examples 3 and 4 are also readily soluble in Group I and Group II base oils. Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

Example 3 above was also used to prepare hydraulic and industrial gear oil lubricants.

TABLE 3a

| Hydraulic Oil | | | |
|---|---|---|---|
| Component Description | Comp 4 | Comp 5 | Ex 14 |
| Chevron 100R (Group II+) | 35.66 | 35.66 | 35.66 |
| Chevron 220R (Group II) | 63.39 | 63.39 | 63.39 |
| ZDDP | 0.53 | 0.53 | 0.53 |
| antioxidant/detergent blend | 0.214 | 0.214 | 0.214 |
| antifoam | 0.0024 | 0.0024 | 0.0024 |
| PIBSA | 0.035 | 0.035 | 0.035 |
| yellow metal inhibitor | 0.0062 | 0.0062 | 0.0062 |
| Ca sulfonate detergent A[1] | 0.04 | | |
| Ca sulfonate detergent B[2] | | 0.035 | |
| Example 3 | | | 0.03 |
| demulsifier | 0.008 | 0.008 | 0.008 |
| diluent oil | 0.0144 | 0.0194 | 0.0244 |
| pour point depressant | 0.1 | 0.1 | 0.1 |
| sum: | 100 | 100 | 100 |

[1]neutral calcium alkylaryl sulfonate

[2]calcium alkylaryl sulfonate with a succinic acid component

TABLE 3b

| Hydraulic Oil Test Results | | Test Method | Comp 4 | Comp 5 | Ex 14 |
|---|---|---|---|---|---|
| Level in additive package | | | 4.70% | 4.10% | 3.50% |
| % Ca in additive package | | ASTM D5185 | 0.42% | 0.41% | 0.43% |
| Treat rate of package in finished fluid | | | 0.85% | 0.85% | 0.85% |
| Steel pin corrosion | | ASTM D 665 B | PASS | PASS | PASS |
| Demulsibility | oil-water-emulsion | ASTM D 1401 | 32-37-11 | 02-33-45 | 37-37-6 |
| | (time), minutes | | −30 | −30 | −30 |
| Foaming | tendency/stability | ASTM D 892 | 0/0 | 190/0 | 0/0 |
| | Sequence I, mL | | | | |

TABLE 4a

| Industrial Gear Oils | | | |
|---|---|---|---|
| Description | Comp 6 | Comp 7 | Ex 15 |
| XOM Core 600 (Group I) | 48.65 | 48.65 | 48.65 |
| XOM Core 2500 (Group I) | 48.65 | 48.65 | 48.65 |
| yellow metal inhib. | 0.07 | 0.07 | 0.07 |
| EO-PO corr. inhib. | 0.006 | 0.006 | 0.006 |
| borated dispersant | 0.11 | 0.11 | 0.11 |
| phos AW/EP/FM | 0.567 | 0.567 | 0.567 |
| phosphate rust inhibitor | 0.045 | 0.045 | 0.045 |
| sulfur EP | 1.2 | 1.2 | 1.2 |
| antifoam | 0.02 | 0.02 | 0.02 |
| diluent oil | 0.382 | 0.398 | 0.412 |
| Ca sulfonate detergent A | 0.1 | | |
| Ca sulfonate detergent B | | 0.084 | |
| Example 3 | | | 0.07 |
| pour point depressant | 0.2 | 0.2 | 0.2 |
| sum: | 100 | 100 | 100 |

TABLE 3b

| Industrial Gear Oil Test Results | | | | | |
|---|---|---|---|---|---|
| | | Test Method | Comp 6 | Comp 7 | Ex 15 |
| Level in additive package | | | 4.00% | 3.40% | 2.80% |
| ppm Ca in additive package | | ASTM D5185 | 795 | 682 | 762 |
| Level of package in finished fluid | | | 2.50% | 2.50% | 2.50% |
| Steel pin corrosion | | ASTM D 665 B | PASS | PASS | PASS |
| Copper Corrosion | | ASTM D130 3 hours 100° C. | 1B | 1B | 1B |
| Demulsibility | oil-water-emulsion (time), minutes | ASTM D 1401 | 41-39-0 (10) | 41-37-2 (10) | 41-37-2 (10) |
| Oxidative Stability | % viscosity change | ASTM D 2893 121° C. | 4.90% | 5.20% | 5.10% |

As used herein, the transitional term "comprising," which is synonymous with "including," "containing," or "characterized by," is inclusive or open-ended and does not ex-dude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially" of permits the inclusion of additional un-recited elements or steps that do not materially affect the basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A composition comprising:

a) from greater than 20 to about 40 percent by weight of an overbased calcium sulfonate detergent; and b) an acid mixture comprising at least two carboxylic acids and at least one hydrocarbyl-substituted organic sulfonic acid that is a mono or di substituted alkylsulfonic acid, i. wherein at least one of the carboxylic acids is a $C_8$ to $C_{36}$ hydrocarbyl-substituted polycarboxylic acid wherein the carboxylic groups are separated by 10 to 20 carbon atoms and at least one of the carboxylic acids is a linear or branched $C_{10}$ to $C_{18}$ hydrocarbyl-substituted monocarboxylic acid, wherein the weight ratio of the polycarboxylic acid to the monocarboxylic acid ranges from 3:1 to 1:1, and ii. wherein the weight ratio of the at least one hydrocarbyl-substituted organic sulfonic acid to the at least two carboxylic acids ranges from 15:1 to 3:1, wherein the weight ratio of a) the overbased calcium sulfonate detergent to b) the acid mixture ranges from 2:1 to 1:3; and wherein the total base number ("TBN") of the composition ranges from at least 10 to 65 mg KOH/g.

2. The composition of claim 1, wherein the mono or di substituted alkylsulfonic acid is a naphthalene sulfonic acid, alkylbenzene sulfonic acid, or combinations thereof.

3. The composition of claim 1, wherein the at least one carboxylic acid comprises a hydroxyalkyl carboxylic acid-ester.

4. The composition of claim 1, wherein the at least one polycarboxylic acid is a dicarboxylic acid, a tricarboxylic acid, or mixtures thereof.

5. The composition of claim 4, wherein the dicarboxylic acid is a $C_{36}$ dicarboxylic acid.

6. The composition of claim 4, wherein the tricarboxylic acid is a $C_{21}$ tricarboxylic acid.

7. The composition of claim 4, wherein dicarboxylic acid is a $C_{36}$ dicarboxylic acid and the monocarboxylic acid is a linear unsaturated $C_{14}$ to $C_{18}$ hydrocarbyl-substituted monocarboxylic acid.

8. A coating composition comprising the composition of claim 1, a solvent, an oil, or mixtures thereof.

9. A lubricant composition comprising the composition of claim 1 and an oil of lubricating viscosity.

10. The lubricant composition of claim 9, wherein the lubricant composition is an industrial gear oil, a hydraulic oil, or a grease.

11. A method of reducing the corrosion of a metal component, said method comprising contacting said metal component with the composition of claim 1.

* * * * *